US005113663A

United States Patent [19]

Gifford

[11] Patent Number: 5,113,663

[45] Date of Patent: May 19, 1992

[54] MULTI-STAGE CRYOGENIC REFRIGERATOR

[75] Inventor: Peter E. Gifford, Syracuse, N.Y.

[73] Assignee: Cryomech, Inc., Syracuse, N.Y.

[21] Appl. No.: 680,806

[22] Filed: Mar. 11, 1991

[51] Int. Cl.[5] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 2,906,101 | 9/1959 | McMahon et al. | 62/6 |
| 3,205,668 | 4/1965 | Gifford | 62/6 |
| 3,312,072 | 4/1967 | Gifford | 62/6 |
| 3,574,998 | 4/1971 | Bredow et al. | 62/6 |
| 4,335,579 | 6/1982 | Sugimoto | 62/6 |
| 4,490,983 | 1/1985 | Gifford et al. | 62/6 |
| 4,848,092 | 7/1989 | Gifford | 62/6 |

*Primary Examiner*—Ronald C. Capossela
*Attorney, Agent, or Firm*—Wall and Roehrig

[57] ABSTRACT

A multi-stage cryogenic refrigerator utilizing the Gifford-McMahon cycle has an external regenerator in each stage. The external regenerators are vertically stacked and connected in series, so that expanding gas is allowed to flow through the regenerators without significant obstruction or turning motion. The lower regenerators operate at progressively lower temperatures. The packing material within each regenerator has a higher specific heat than that of the regenerator immediately above as determined at the operating temperature of the regenerator.

5 Claims, 5 Drawing Sheets

MULTI-STAGE CRYOGENIC REFRIGERATOR

BACKGROUND OF THE INVENTION

This invention relates to an improved multi-stage cryogenic refrigerator utilizing the Gifford-McMahon refrigeration cycle.

A thermodynamic refrigeration cycle generally referred to as the Gifford-McMahon cycle is disclosed in U.S. Pat. No. 2,906,101. A two-stage refrigerator utilizing this cycle is further described in U.S. Pat. No. 3,312,072 wherein a pair of different diameter displacer cylinders are employed to process helium gas to attain extremely low temperatures. In this particular embodiment, each cylinder slidably contains a displacer that is capable of reciprocating within the cylinder to vary the volume of an expansion chamber located at the bottom of the displacer. Initially, the refrigerant is compressed outside of the chamber to a higher pressure and is then cycled through the chamber to thermodynamically reduce the temperature of the working fluid into the cryogenic region. Prior art machines have been limited in their refrigerating capacity by a pressure drop through the regenerators. These machines typically employ annular gap heat exchangers to transfer heat from the environment to the gas. These exchangers offer considerable mechanical resistance to the passage of the gas. Other machines, particularly those utilizing regenerators employing labyrinthine passageways to conduct the gas through the regenerators. As a consequence, the expanding refrigerant must follow a torturous path as it moves through the regenerator system and is thus prevented from fully expanding to desired atmospheric pressure or below within the short period of a normal displacer cycle. Typically, these prior art machines can attain temperatures of about 10 K. with a capacity of about 10 watts. Lower temperatures are attainable at lower displacer speeds, however, this results in a considerably reduced machine capacity. It is desirable in the art to achieve operating pressures at the discharge port of one atmosphere, or less, but the prior art machines have difficulty in operating under this condition. As a result, such machines cannot attain the extremely low temperatures which are desired except by slowing down the refrigeration cycle. This naturally limits the machines refrigeration capacities.

SUMMARY OF THE INVENTION

It is therefore a primary object of the present invention to improve multi-stage cryogenic machines utilizing the Gifford-McMahon cycle.

It is a further object of the present invention to reduce the operating temperature of a multiple-stage refrigeration machine utilizing the Gifford-McMahon cycle without reducing the machine speed, maximizing its capacity.

It is yet another object of the present invention to increase the efficiency of multiple-stage refrigeration machines utilizing the Gifford-McMahon.

It is still a further object of the present invention to provide a regenerator system for use in a multi-stage Gifford-McMahon refrigerator that is adapted to progressively lower operating temperatures and thus increase the capacity of this type of multiple stage machine.

Another object of the present invention is to attain extremely low cryogenic temperatures using the Gifford-McMahon refrigeration cycle.

These and other objects are realized by a three-stage refrigerator utilizing the Gifford-McMahon cycle having three parallel displacer stages and three vertically-stacked external regenerator units through which refrigerant flows with a minimum amount of resistance during the expansion phase of the cycle. Each regenerator unit in the stacked series contains a packing material having a specific heat that permits the regenerator unit to operate efficiently over a desired temperature range. Due to the design of the regenerator stack, lower temperature can be attained at normal displacer speed without having to reduce the capacity of the refrigerator.

BRIEF DESCRIPTION OF THE DRAWINGS

For a better understanding of these and other objects of the present invention, reference will be made to the detailed description of the invention which is to be read in conjunction with the following drawings, wherein.

DETAILED DESCRIPTION OF THE INVENTION

Referring to FIGS. 1-5, there is illustrated a cold head 10 of a three-stage refrigeration system utilizing the Gifford-McMahon (G.M.) cycle. As will be explained in greater detail below, the present three-stage machine utilizes an external regenerator system 15 that contains three vertically-stacked regenerator units 47-49. The regenerator coacts with three vertically-aligned displacer stages 12, 13 and 14 to enable the refrigerator to attain temperatures well below 7 K. when operating at normal displacer speeds while enhancing machine capacity.

Figure 6:
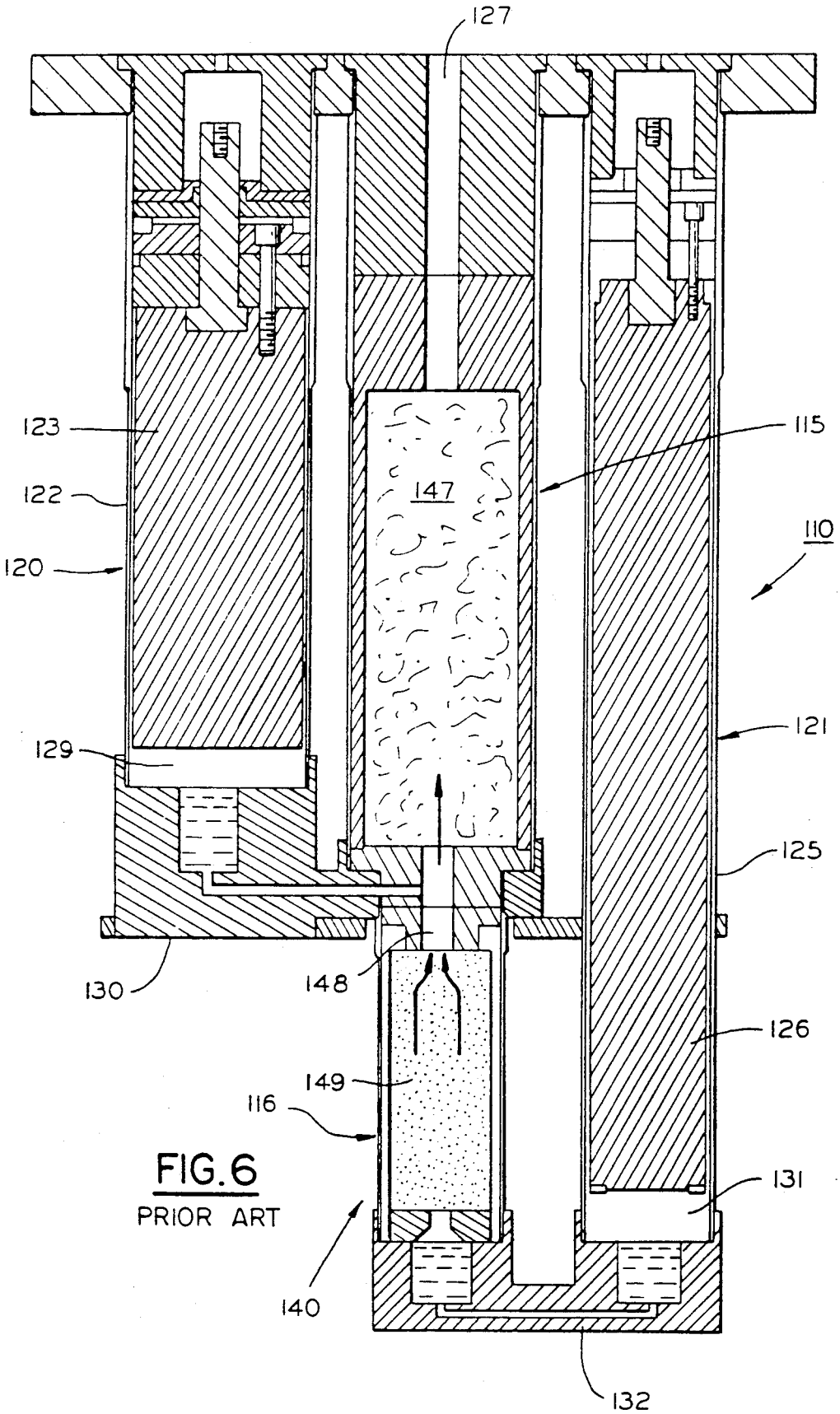
FIG.6 PRIOR ART
FIG. 6 is a schematic sectional view illustrating a prior art, two-stage refrigerator employing the Gifford-McMahon cycle.

FIG. 6 represents a typical prior art two-stage machine 110 employing the G.M. cycle. The machine includes a cold head containing an external regenerator system 140 and two displacer stages 120 and 121. The first displacer stage includes a housing 122 which slidably contains a displacer 123. The second stage includes a housing 125 slidably containing a second smaller diameter displacer 126. High pressure refrigerant, generally helium gas, is delivered to the cold head through a combination inlet/outlet passage 127 from the discharge side of a compressor (not shown) at about 300 psi. Incoming high pressure refrigerant passes in series through a first stage regenerator unit 115 and a second smaller second-stage regenerator unit 116. Some of the incoming refrigerant is delivered to the expansion chamber 129 of the first stage displacer through heat exchanger 130 while most of the remaining high pressure refrigerant is delivered to the expansion chamber 131 of the second displacer stage via heat exchanger 132.

The lower portion of each displacer housing is typically referred to as the cold end while the top portion is referred to as the warm end.

Specific heat is defined as the amount of heat required to change the temperature of a unit of mass of a substance through one degree of temperature. For a given process the specific heat is not constant but rather a function of temperature. Accordingly, some materials exhibit a high specific heat within certain temperature ranges. In the case of the cryogenic regenerator units used in a G.M. multi-stage refrigerator, the units are packed with materials that exhibit high specific heat within the operating range of the associated displacer stage. The regenerator units can thus be matched to the displacer stage to provide for highly efficient storage of energy. The first stage regenerator unit 115 is typically packed with stainless steel or phosphorous bronze screen which exhibits high specific heat from room or ambient temperature down to about 30 K. The second stage regenerator unit 116, which is connected in fluid flow communication to the first stage unit by a relatively small flow passage 148, is normally packed with lead shot 149 which exhibits high specific heat between 30 K. and 12 K. Although not shown, suitable screens are employed to prevent the packing materials from escaping the regenerator housings.

The cycle employed in the two-stage machine consists of four basic steps. First, refrigerant gas is charged at high pressure into each of the expansion chambers. Second, the high pressure gas moves the displacers to the full up position as shown. Third, the high pressure gas is exposed by means of a rotary valve system (not shown) to the low pressure side of the system compressor. The high pressure refrigerant thus expands upwardly through the regenerator and is permitted to rapidly expand to the lower suction side pressure thus cooling the refrigerant. As the gas passes through the regenerators, the packing material is cooled. Lastly, the displacers are forced downwardly pushing the remaining refrigerant from the chambers. Repeating the cycle at a relatively rapid rate brings the cold head temperature well down into the cryogenic range.

As noted, the dynamics of the two-stage G.M. refrigerator requires that high pressure helium expand to a lower pressure as it passes upwardly through the regenerator units. The time allotted to complete the expansion phase of the cycle is relatively short because of design constraints. Additionally, little consideration has heretofore been given to the flow path that the expanding gas is forced to travel as it passes through and between regenerator units. Typically, the refrigerant encounters a number of restrictions within the flow path. The refrigerant generally cannot be expanded much below three atmospheres in the short time allotted and temperatures below 12 K. are usually not attainable by a conventional two-stage G.M. refrigerator.

It has been observed, that by turning off a two-stage G.M. machine during the expansion phase of the cycle and allowing the refrigerant to expand to atmospheric pressure, temperatures well below 12 K. can be attained. These low temperatures, however, cannot be sustained at normal operating speeds for the reasons noted above.

Applicant's present invention overcomes many of the problems found in the art by providing a regenerator system having greater heat storage capacity and a flow path that allows the expanding refrigerant to pass in an unrestricted manner through the regenerators. As a result, lower temperatures are now attainable using the G.M. refrigeration cycle without sacrificing machine capacity.

Turning back to FIGS. 1-5, the present regenerator system contains three stages of regeneration with the units being depicted at 47, 48 and 49. The regenerator units are stacked in vertical alignment, one over the other. The regenerator units are connected to the cold end of companion displacer stages by means of heat exchangers 41, 42 and 43.

Figure 1:
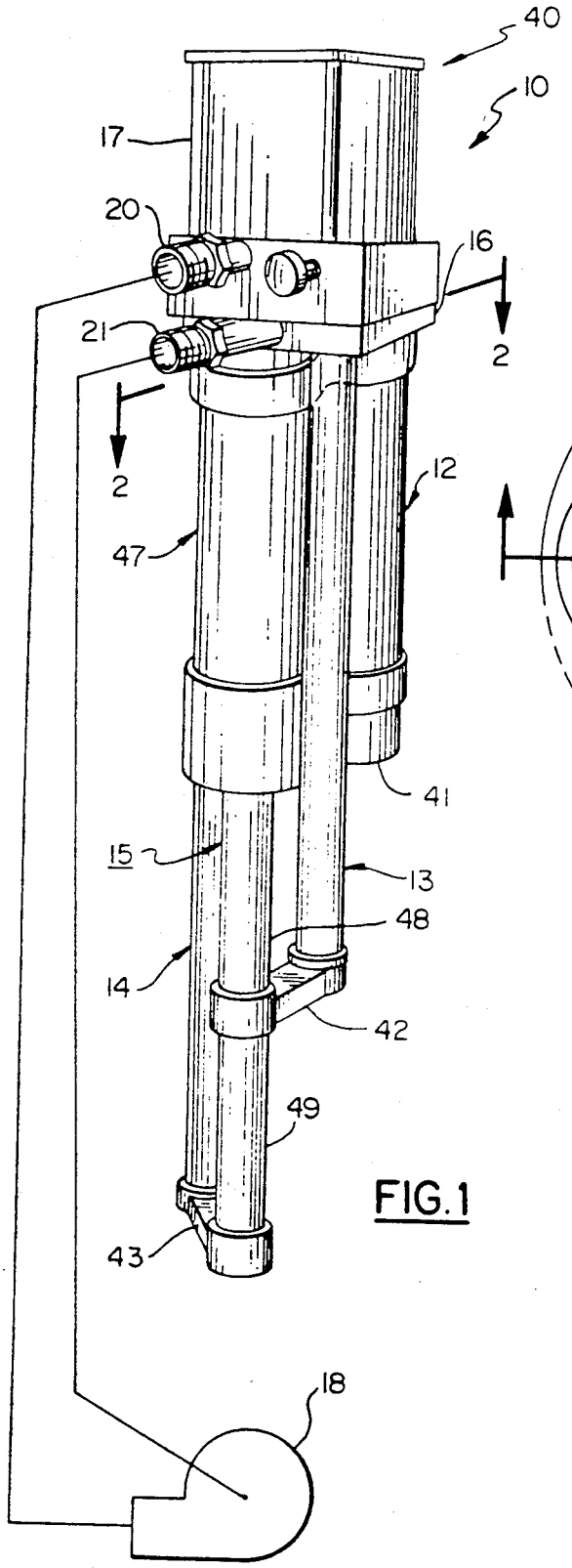
FIG. 1 is a perspective view showing a multi-stage cryogenic refrigerator embodying the teachings of the present invention.
Figure 2:
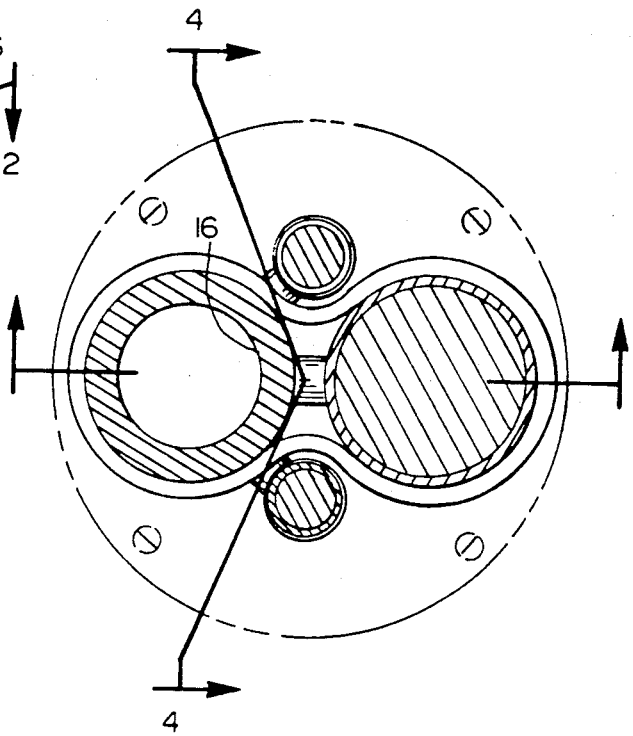
FIG. 2 is an enlarged sectional view taken along lines 2—2 in FIG. 1.
Figure 3:
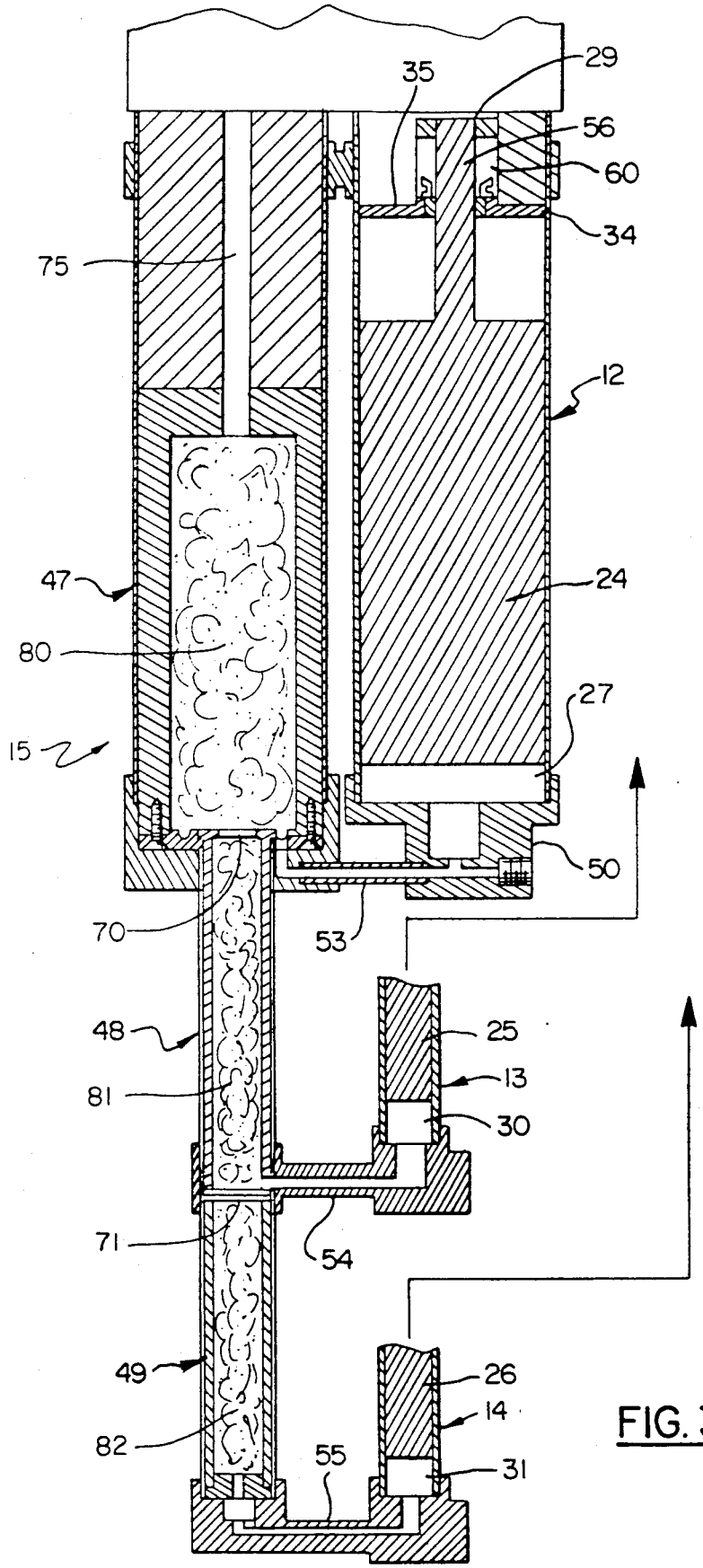
FIG. 3 is an enlarged side elevation in section of the cryogenic refrigerator shown in FIG. 1.
Figure 4:
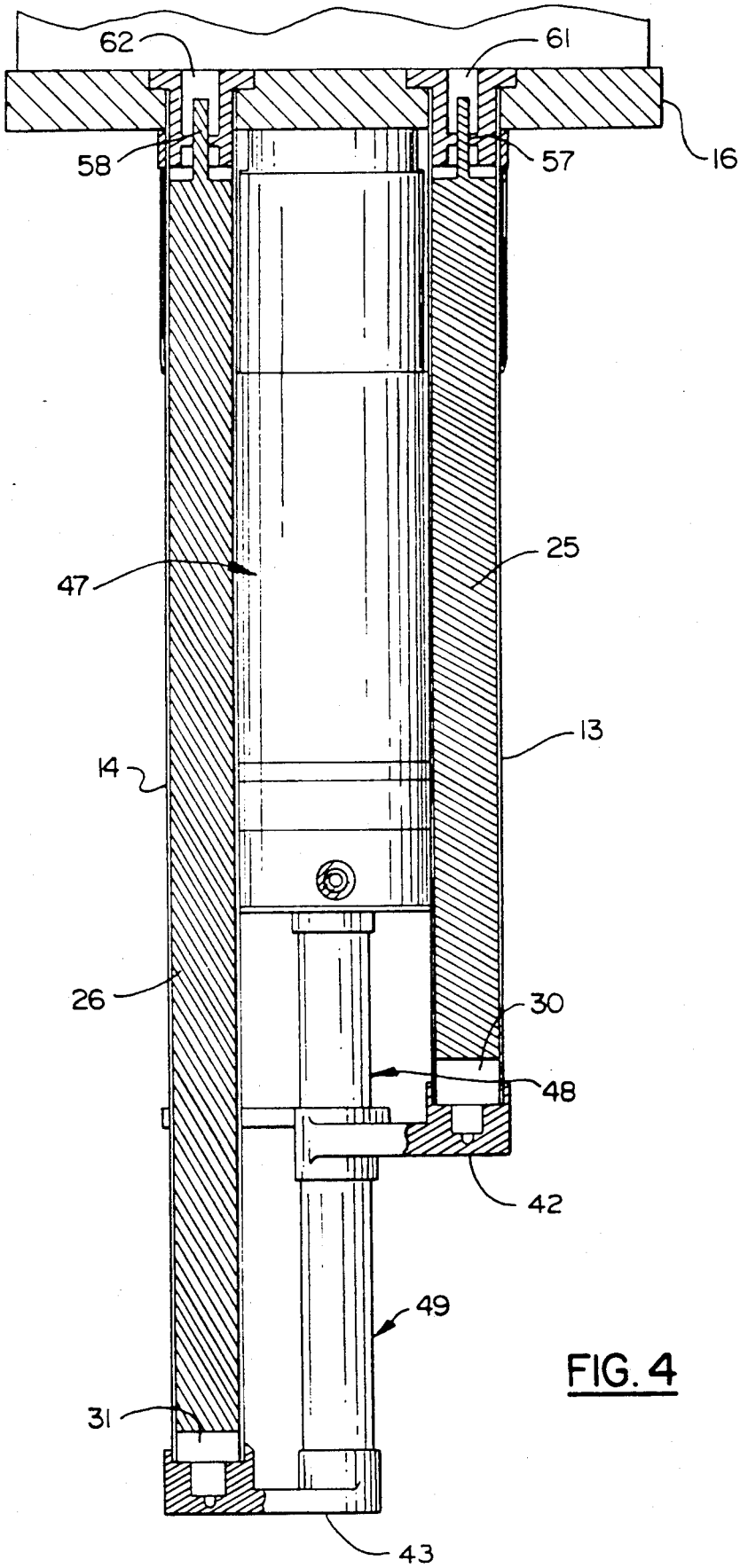
FIG. 4 is a sectional view taken along lines 4—4 in FIG. 2.
Figure 5:
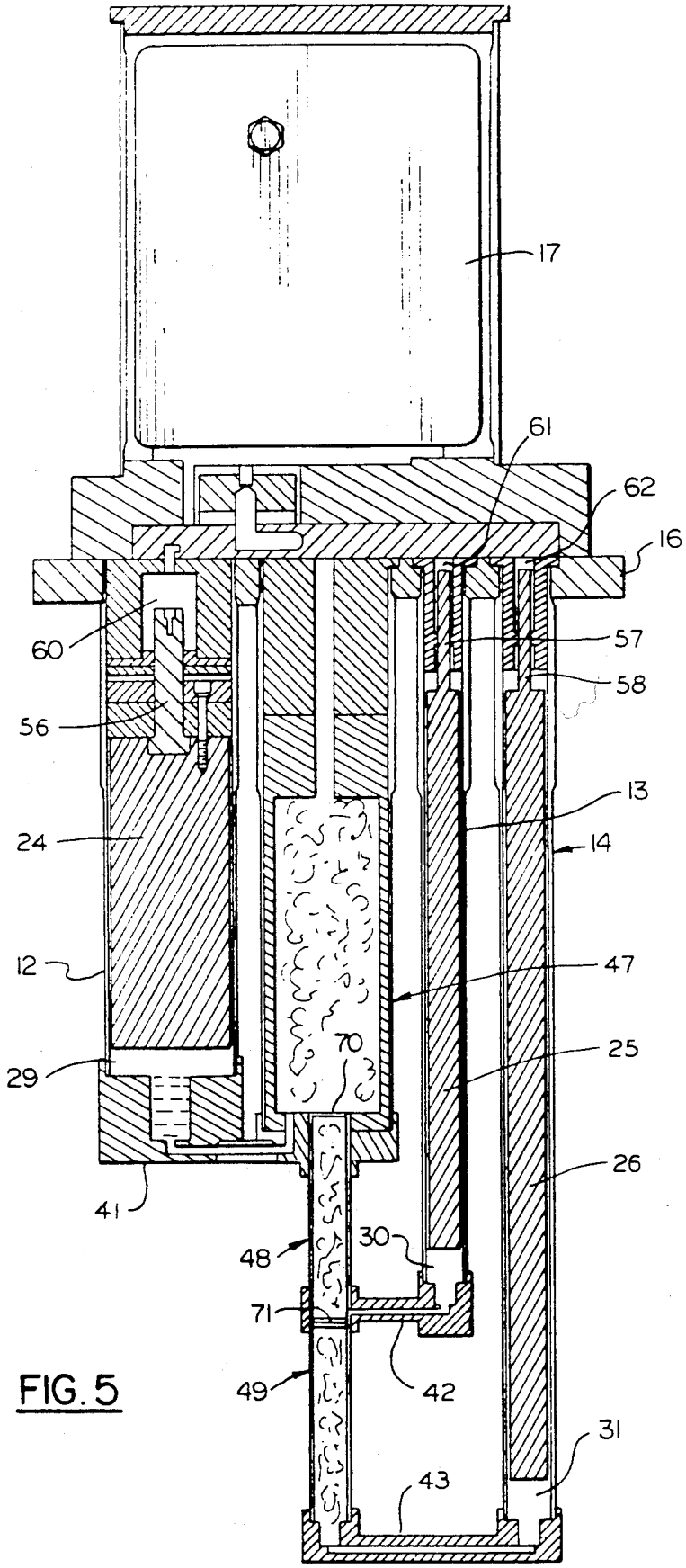
FIG. 5 is a further side elevation in section of the present refrigerator showing further details thereof.

As best illustrated in FIG. 1, cold head 10 includes a control section 40 containing a rotary valve (not shown) that is mounted directly over pressure head 16. The rotary valve is driven by electric motor 17 to selectively sequence refrigerant in and out of the cold head. Refrigerant is supplied by a suitable line to the cold head from the discharge side of a compressor 18 through inlet port 20. The suction side of the compressor is similarly connected to the outlet port 21 of the cold head thus allowing the refrigerant to be recycled back through the compressor during the expansion phase of the cycle. To the extent necessary to more fully understand the operation of the multi-stage G.M. cycle and the function of the rotary valve system, reference is made to the teachings found in U.S. Pat. Nos. 2,906,101 and 3,312,072 to Gifford and McMahon which are incorporated herein by reference. High pressure refrigerant gas, which in this case is helium, is delivered from the compressor to the cold head at about 300 psi and is returned to the suction side of the compressor at about one atmosphere or 14.7 psi.

The vertically-disposed displacer stages 12, 13 and 14 depend from the pressure head 16 and contain movable displacers 24, 25 and 26, respectively, therein. The displacers are rod-shaped members that are slidably contained within the displacer stage housings to establish variable volume expansion chambers 29, 30 and 31, at the cold end of each stage. The vertical length of the displacer housings are varied with the first stage housing being the shortest, the third stage housing being the longest and the second stage housing being intermediate that of the first and third stages.

Each displacer stage is operatively connected to the regenerator unit 15 by means of heat exchangers 53, 54 and 55. As noted above, the regenerator unit houses three separate regenerators 47, 48 and 49 that are stacked vertically one above the other. Each regenerator is arranged to service one of the displacer stages through the connecting heat exchanger whereby regenerator 47 services displacer stage 12, regenerator 48 services displacer stage 13 and regenerator 49 services displacer stage 14. Drive pistons 56, 57 and 58 are mounted on top of the displacer cylinders. As explained in greater detail in the above-noted patents, the drive pistons coact with the rotary valve to admit high pressure refrigerant into drive chambers 60, 61 and 62, respectively. This, in turn, drives the cylinders downwardly to close the expansion chamber and thus help drive the refrigerant back through the regenerator units to the compressor. The displacer cylinders are arranged to reciprocate between about 120 and 160 cycles per minute during normal machine operation.

First regenerator unit 47 is mounted next to the first displacer stage 12 while the second regenerator 48 is similarly mounted next to the second displacer stage 13 and the third regenerator 49 is mounted adjacent to the third displacer stage 14. The lower or cold end of each regenerator is connected to the cold end of each displacer stage by means of the previously noted heat exchangers 53-55 so that refrigerant gas can flow freely therebetween. The warm or upper end of the first regenerator 47 is connected to an inlet/outlet passage 75 that permits refrigerant to pass freely between the compressor and the warm end of the regenerator system. In accordance with the teachings of the noted Gifford and McMahon patents, helium gas at high pressure is permitted to flow downwardly through the three regenerator units and into the heat exchangers 53, 54, 55 of the three displacer stages whereupon the displacer cylinders are moved to their full-up positions. The rotary control valve is then cycled and the refrigerant gas is exposed to the low pressure side of the compressor. The gas now rapidly expands and it moves upwardly through the vertically-stacked regenerators. As will be explained below, each regenerator unit is packed with a material that has a different specific heat. Screens 70 and 71 are used to prevent the packing materials from moving between adjacent regenerator units while at the same time allowing the refrigerant to flow freely therebetween in both directions. The expanding gas rapidly cools the packing material as it moves upwardly through the regenerators and is cooled as it returns to the expansion chambers through the regenerator units. In operation, the upper regenerator 47 is packed with a material 80 having a specific heat that allows the regenerator to store energy and thus operate efficiently between ambient temperatures and about 30 K. This material can be either phosphorous bronze or stainless steel screen. The intermediate regenerator 48 is packed with a material 81 that has a specific heat that allows the regenerator to operate efficiently in a approximate range of between 30 K. and 12 K. In this case lead shot is employed. The lowermost regenerator 49 is packed with a material 82 that has a specific heat such that the regenerator can operate efficiently at temperatures below 12 K. Materials such as neodymium and erbium-nickel may be used for this purpose.

In the present stacked regenerator system, the lowermost regenerator in the stack is arranged to open fully into the next upper regenerator so that the expanding refrigerant gas can pass between units without physical interruption or any adverse pressure drop. By design, the inlet/outlet passage 75 is at about atmospheric pressure during the expansion phase of the cycle. As a result, the expanding gases flow upwardly with a minimum amount of resistance and are able to expand rapidly to atmospheric pressure within the time frame that it takes for the displacer cylinders to reach a fully down position.

A greater amount of the total refrigerant is passed through the uppermost regenerator unit and therefore the capacity of this unit must be greater than that of the other two units. All the regenerator units are of sufficient capacity to store the refrigeration achieved by the respective stage as it is cycled through the system. Tests conducted on a three-stage G.M. refrigerator containing a regenerator system constructed as noted above clearly demonstrated that the machine is capable of attaining and maintaining temperatures below 5.5 K.

While this invention has been described in detail with respect to preferred embodiments, it should be recognized that the invention is not limited to those embodiments. Rather, many modifications and variations would present themselves to those skilled in the art without departing from the scope and spirit of this invention, as defined in the appended claims.

What is claimed is:

1. A cryogenic refrigerator using the Gifford-McMahon cycle that includes three spaced-apart, vertically disposed displacer stages with the cold end of each displacer stage located at the bottom section of each stage, an external regenerator means having three regenerator units stacked vertically one above the other adjacent to said displacer stages, a heat exchanger for placing the cold end of each displacer stage in fluid flow communication with the lower end of one of said regenerator units whereby refrigerant is freely exchanged therebetween, control means for passing a high pressure refrigerant from a compressor means downward in series through the regenerator units whereby refrigerant enters each of the displacer stages, and then exposing the regenerator units to the suction side of the compressor so that the refrigerant expands rapidly to about atmospheric pressure as it moves upwardly through said stacked regenerators.

2. The refrigerator of claim 1 wherein the regenerator units are each packed with materials having different specific heats.

3. The refrigerator of claim 2 wherein the uppermost regenerator is packed with a first material having a specific heat such that it will efficiently store energy within a temperature range between about room temperature and about 30 K., the intermediate regenerator unit in the stack being packed with a second material having a specific heat such that it will efficiently store energy within a temperature range of between about 30 K. and about 12 K., and the lowermost regenerator unit in the stack being packed with a third material having a specific heat such that it will efficiently store energy at temperatures below 12 K.

4. The refrigerator of claim 3 wherein said first material is selected from the group consisting of stainless steel and phosphorous bronze, said second material is lead and said third material is selected from the group consisting of neodymium and erbium-nickel.

5. The refrigerator of claim 1 wherein each regenerator is cylindrical in form and each lower regenerator unit opens fully into the next upper regenerator unit so that expanding refrigerant moving upwardly through the stack is exchanged between units without restriction.

* * * * *